US006705364B2

(12) United States Patent
Ellison

(10) Patent No.: US 6,705,364 B2
(45) Date of Patent: Mar. 16, 2004

(54) LOG SPLITTING APPARATUS AND METHOD OF USE OF THE SAME

(76) Inventor: Charles Robert Ellison, Box #9, Site #3, R.R. 1, Dapp, Alberta, T0G 0S0 (CA)

( * ) Notice: Subject to any disclaimer, the term of this patent is extended or adjusted under 35 U.S.C. 154(b) by 0 days.

(21) Appl. No.: 10/225,509

(22) Filed: Aug. 21, 2002

(65) Prior Publication Data

US 2003/0056854 A1 Mar. 27, 2003

(30) Foreign Application Priority Data

Sep. 26, 2001 (CA) ..... 2357903

(51) Int. Cl.[7] ..... B27L 7/00

(52) U.S. Cl. ..... 144/366; 173/123; 144/193.1; 144/194

(58) Field of Search ..... 144/193.1, 194, 144/366; 173/123, 93.5

(56) References Cited

U.S. PATENT DOCUMENTS 4,091,851 A 5/1978 Ober ..... 144/193
4,245,683 A 1/1981 Cedergren ..... 144/194
4,347,881 A 9/1982 Wickham et al. ..... 144/194
4,491,164 A * 1/1985 Waikas et al. ..... 144/194
4,669,552 A * 6/1987 Foster et al. ..... 173/123 X
5,018,792 A * 5/1991 Roussin et al.
5,622,230 A * 4/1997 Giardino et al. ..... 173/93.5

* cited by examiner

*Primary Examiner*—W. Donald Bray
(74) *Attorney, Agent, or Firm*—Christensen O'Connor Johnson Kindness PLLC

(57) ABSTRACT

A method and an apparatus for splitting logs which includes a combination of an impact wrench and a conical screw-form wedge. A first step involves providing an impact wrench and a conical screw-form wedge. A second step involves coupling the conical screw-form wedge to the output coupling of the impact wrench. A third step involves placing the apex of the conical screw-form wedge against a log and activating the rotary and reciprocating movement of the impact wrench. The combined rotary and reciprocating movement of the impact wrench drives the conical screw-form wedge into the log. The described combination is a compact, portable and comparatively inexpensive log splitting apparatus.

2 Claims, 3 Drawing Sheets

LOG SPLITTING APPARATUS AND METHOD OF USE OF THE SAME

FIELD OF THE INVENTION

The present invention relates to a log splitting apparatus and, in particular, a log splitting apparatus that uses a conical screw-form wedge.

BACKGROUND OF THE INVENTION

Log splitting apparatus that use conical screw-form wedges are disclosed in U.S. Pat. No. 4,091,851 (Ober 1978); U.S. Pat. No. 4,245,683 (Cedergren 1981) and U.S. Pat. No. 4,347,881 (Wickham et al 1982). The Ober reference discloses a log splitting apparatus driven by an internal combustion engine of about 5 to 8 horsepower capacity and having a maximum output speed of about 3500 to 3600 revolutions per minute. A speed reduction unit is used to reduce the revolutions per minute down between 60 to 70 revolution per minute, which is viewed by Ober as being the preferred operating range for splitting logs with a conical screw-form wedge. The Cedergren reference discloses a protective guard which mounts to a work table to protect a workman from injury when using a conical screw-form wedge in a shop environment. The log splitting machine is not described. The Wickham reference discloses a log splitting apparatus driven off of the power take off (PTO) of a tractor. The reference includes features to improve the manner in which logs are fed onto and off of the conical screw-form wedge and features to protect the PTO shaft from fracturing due to induced bending stresses.

The above described apparatus are suitable for persons splitting large volumes of logs. Such apparatus are not suitable for use by persons who wish to camp overnight or picnic during an afternoon outing. Persons who camp or picnic generally have limited storage space to transport a log splitting apparatus and only split a few logs.

SUMMARY OF THE INVENTION

What is required is a hand held portable log splitting apparatus.

According to a first aspect of the present invention there is provided an apparatus for splitting logs which includes a combination of an impact wrench and a conical screw-form wedge. The impact wrench has an output coupling that provides both rotary and reciprocating movement. The conical screw-form wedge is coupled to the output coupling of the impact wrench.

According to another aspect of the present invention there is provided a method of splitting logs. A first step involves providing an impact wrench and a conical screw-form wedge, as described above. A second step involves coupling the conical screw-form wedge to the output coupling of the impact wrench. A third step involves placing the apex of the conical screw-form wedge against a log and activating the rotary and reciprocating movement of the impact wrench. The combined rotary and reciprocating movement of the impact wrench drives the conical screw-form wedge into the log.

The prior art devices such as disclosed in the Ober reference and the Wickham et al reference rely upon generating sufficient torque output to drive the conical screw-form wedge into a log. When one attempts to provide a miniature portable log splitting apparatus follow the same principles as are found in the Ober reference and the Wickham et al reference, the results are not satisfactory as the torque generated is inadequate. In contrast, beneficial results may be obtained through the combination apparatus and method described above. The additional reciprocating movement of the impact wrench, enables the conical screw-form wedge to operate effectively with decreased torque.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
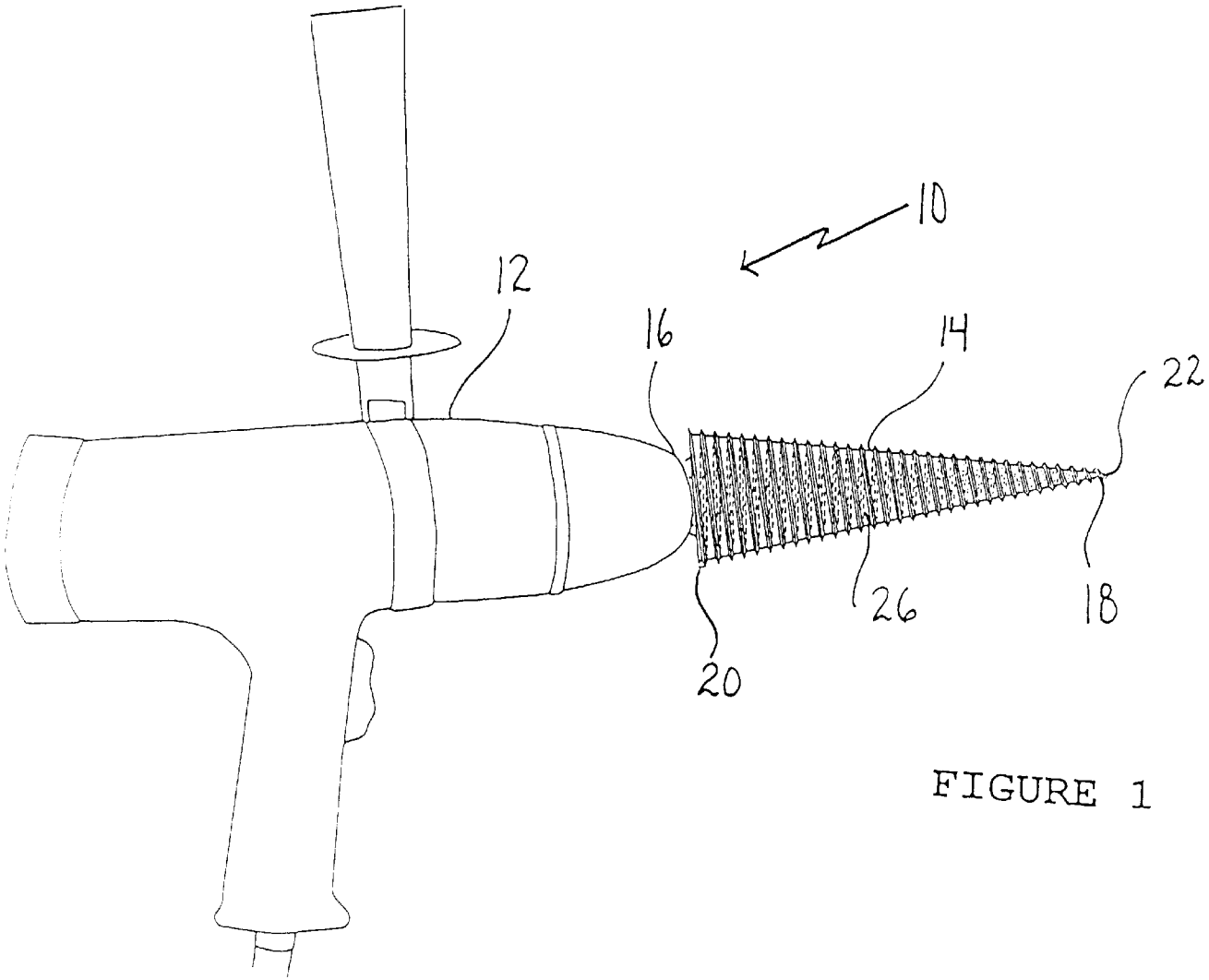
FIG. 1 is a side elevation view of a log splitting apparatus constructed in accordance with the teachings of the present invention, being used in accordance with the teachings of the preferred method.

The preferred embodiment, a log splitting apparatus generally identified by reference numeral 10, will now be described with reference to FIGS. 1 through 4.

Figure 2:
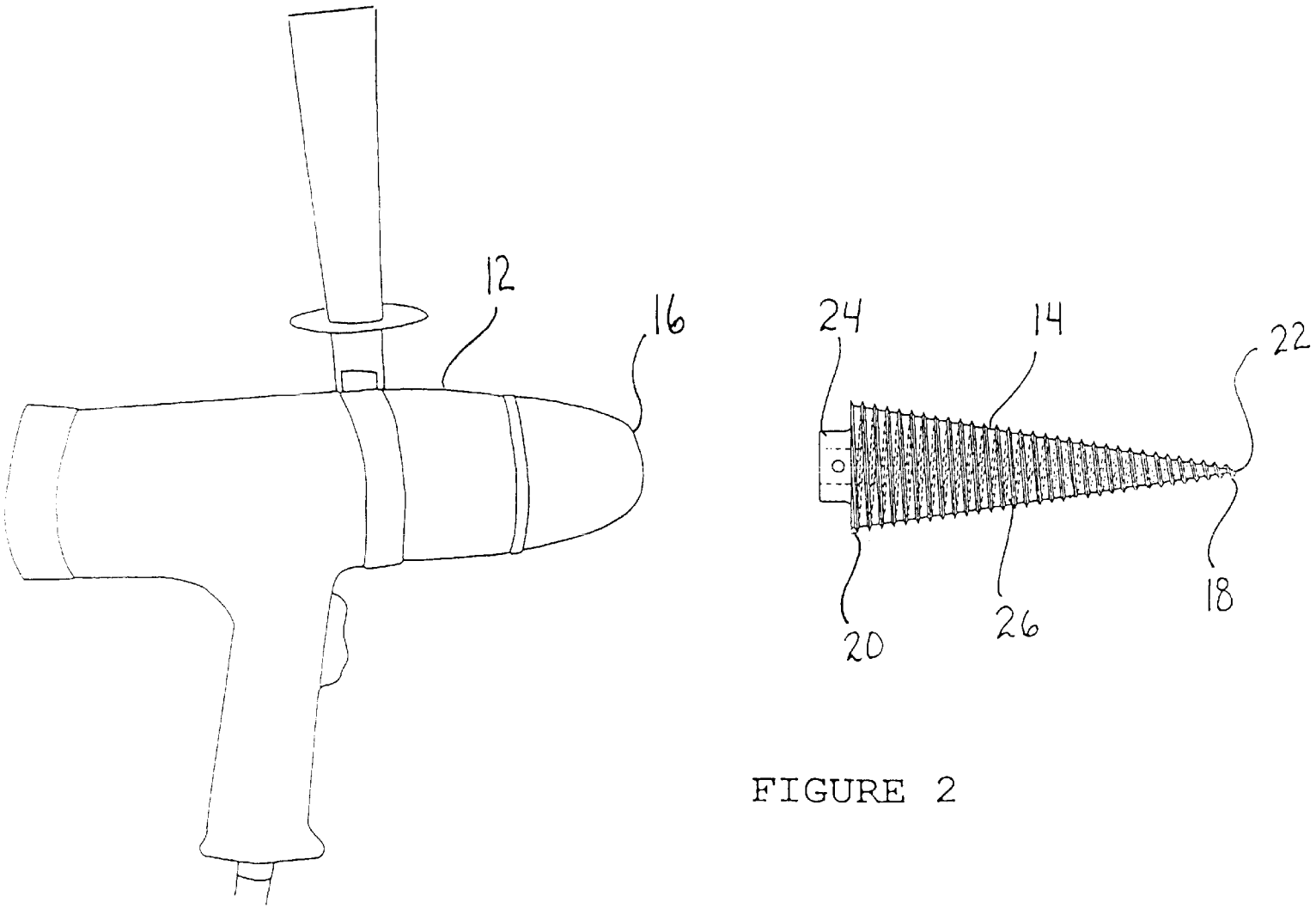
FIG. 2 is an exploded side elevation view of the log splitting apparatus illustrated in FIG. 1.

Structure and Relationship of Parts:

Referring to FIG. 1 there is provided an apparatus for splitting logs 10 which includes, in combination, an impact wrench 12 and a conical screw-form wedge 14. Referring to FIG. 2, impact wrench 12 has an output coupling 16 that provides both rotary and reciprocating movement. Conical screw-form wedge 14 is coupled to output coupling 16 of impact wrench 12. Conical screw-form wedge 14 has a first end 18 and a second end 20. A pointed apex 22 is positioned at first end 18 and a coupling 24 is positioned at second end 20. Conical screw-form wedge 14 has a body 26 that increases in diameter from apex 22 at first end 18 toward second end 20. Coupling 24 at second end 20 is adapted to be coupled to output coupling 16 of impact wrench 12. In the illustrated embodiment, coupling 16 is square shaped, however alternative configurations of couplings 16 can also be used depending on output coupling 16 of impact wrench 12 as will hereinafter be discussed.

Operation:

The use and operation of apparatus for splitting logs will now be described with reference to FIGS. 1 through 4.

Referring to FIG. 1, when it is necessary to split logs, impact wrench 12 and a conical screw-form wedge 14 as described above, can be used. Conical screw-form wedge 14 is coupled to output coupling 16 of impact wrench 12. Impact wrench 12 can be either an electric, pneumatic or hydraulic impact wrench 12. Apex 22 of conical screw-form wedge 14 is then placed against a log. Rotary and reciprocating movement of impact wrench 12 is activated so that the combined rotary and reciprocating movement drives conical screw-form wedge 14 into log to split log apart.

Because apparatus for splitting logs 10 is relatively small and light enough to be portable, it can be used in situations where large log splitting machines are not appropriate such as picnic sites, overnight campsite, or site that are generally inaccessible to larger log splitting devices. Furthermore, apparatus 10 does not require a substantial amount of strength to operate therefore even individuals without substantial strength can operate apparatus for log splitting 10.

Figure 3:
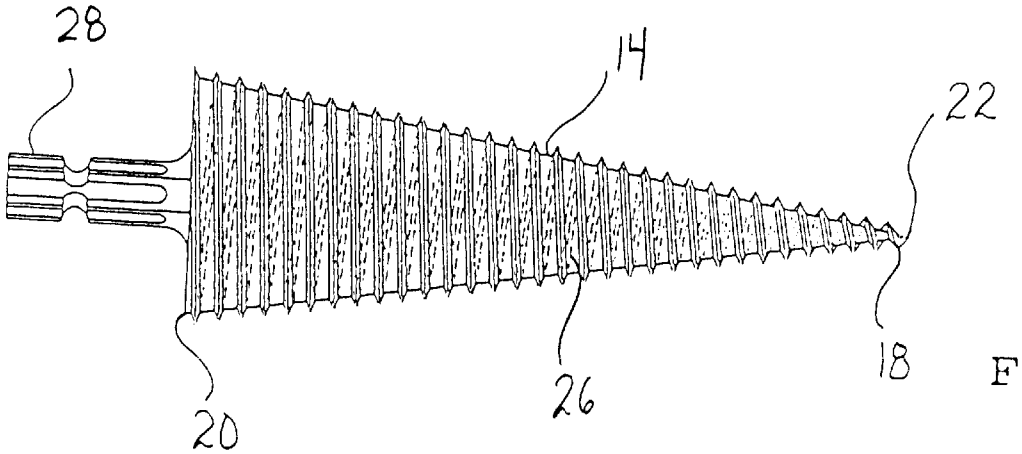
FIG. 3 is a side elevation view of a conical screw-form wedge having a first alternative form of coupling for coupling to an output coupling of an impact wrench.
Figure 4:
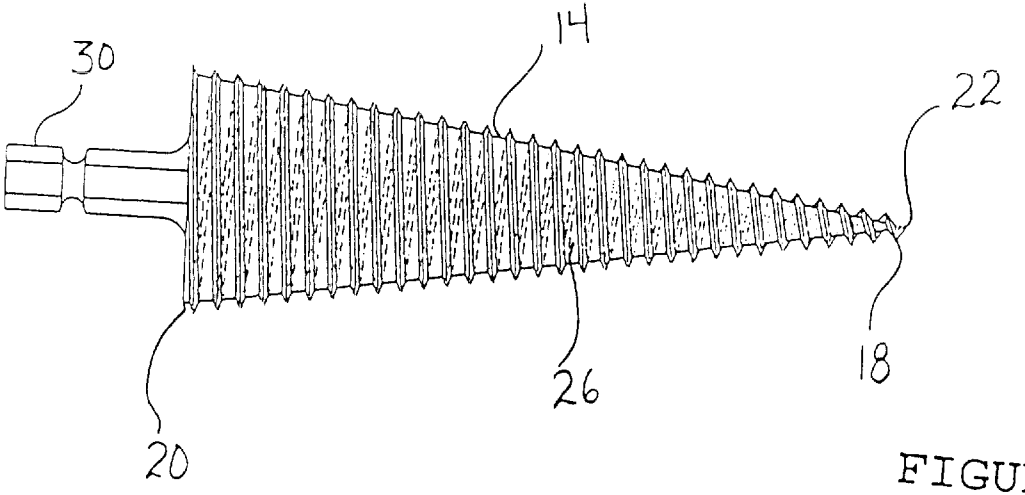
FIG. 4 is a side elevation view of a conical screw-form wedge having a second alternative form of coupling for coupling to an output coupling of an impact wrench.

Variations:

In order to practise the teaching of the present invention, conical screw-form wedges will have to be manufactured that are capable of being coupled to the output coupling of an impact wrench. Three of the more popular forms of coupling are shown. Referring to FIG. 1, coupling on conical screw-form wedge 14 can have a square shaped coupling 24. Referring to FIG. 3, as an alternative, conical screw-form wedge 14 can have a star shaped coupling 28. Referring to FIG. 4, as another example, conical screw-form wedge 14 could have a hexagon shaped coupling 30.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. An apparatus for splitting logs comprising, in combination:

an impact wrench with an output coupling that provides both two way rotary and reciprocating movement; and a one piece conical screw-form wedge directly coupled to the output coupling of the impact wrench.

2. A method of splitting logs, comprising the steps of:

firstly, providing an impact wrench with an output coupling that provides both two way rotary and reciprocating movement, and a one piece conical screw-form wedge having an apex;

secondly, coupling the conical screw-form wedge directly to the output coupling of the impact wrench;

thirdly, placing the apex of the conical screw-form wedge against a log and activating the rotary and reciprocating movement of the impact wrench, whereby the combined rotary and reciprocating movement drives the conical screw-form wedge into the log.

* * * * *